US006386400B1

(12) United States Patent
Scheindel

(10) Patent No.: US 6,386,400 B1
(45) Date of Patent: May 14, 2002

(54) PROPELLANT DISCHARGE FOR A PRESSURIZED DISPENSING CONTAINER

(76) Inventor: Christian T. Scheindel, 2065 Ridge Rd., Randolph Center, VT (US) 05061

( * ) Notice: Subject to any disclaimer, the term of this patent is extended or adjusted under 35 U.S.C. 154(b) by 0 days.

(21) Appl. No.: 09/837,059

(22) Filed: Apr. 18, 2001

(51) Int. Cl.[7] ..... B67D 5/42
(52) U.S. Cl. ..... 222/387; 222/389; 222/402.22
(58) Field of Search ..... 222/387, 402.21, 222/402.22, 402.23, 389

(56) References Cited

U.S. PATENT DOCUMENTS 2,808,806 A 10/1957 Tysinger
2,914,224 A 11/1959 Michel
2,957,610 A 10/1960 Michel
2,965,270 A 12/1960 Soffer et al.
3,926,349 A * 12/1975 Schultz ..... 202/402.22
4,805,813 A 2/1989 Metcoff et al.
5,785,301 A 7/1998 Scheindel

* cited by examiner

*Primary Examiner*—Philippe Derakshani
(74) *Attorney, Agent, or Firm*—Reed Smith LLP

(57) ABSTRACT

A pressurized dispensing container includes a stop between piston and container cap to provide a gap through which propellant can be dispensed through an open valve or after the end of the dispensing of the material that is in the zone between piston and cap. This stop can be designed to keep the piston orthogonal. Excess pressurized propellant will be dispensed through the valve in its open state by forcing its way through the clearance between piston and can sidewall, through the gap between piston and cap and out of the open valve. Alternatively, the stop can also cause the piston to skew thereby providing an enhanced passageway around the piston for propellant that then exits through gap and open valve.

15 Claims, 5 Drawing Sheets

PROPELLANT DISCHARGE FOR A PRESSURIZED DISPENSING CONTAINER

BACKGROUND OF THE INVENTION

This invention relates to a technique for discharging the remaining propellant in a valve operated pressurized container after the product has been dispensed and also to an advantageous use of that remaining propellant in a particular application.

Hand-held pressurized dispensing containers, and particularly those having a tilt action valve assembly, have been known for a long time. Applicant's U.S. Pat. No. 5,785,301 is representative of a prior art valve design for use in these pressurized dispensing containers.

The free floating piston that is used in these dispensing containers has a propellant underneath the piston and the product above the piston. In general, the product being dispensed forms a seal between the piston sidewall and the can and thus prevents propellant by-pass. In most cases, the product is forced between the piston sidewall and the can wall during the process of filling the can with the product to be dispensed and this seals the propellant from the product. This is described in greater detail in the U.S. Pat. No. 3,897,672.

When all of the product has been dispensed, the piston is near the top of the can and normally a substantial amount of propellant remains in the can under the piston.

It is desirable that this propellant be discharged prior to disposal of the can so as to minimize such effects as having the can explode.

Furthermore, and from a different point of view, any utility that can be found for this remaining propellant would provide an added value at no additional cost.

Accordingly, it is a major purpose of this invention to provide a technique for readily and simply disposing of the remaining propellant in a pressurized dispensing container after the product has been dispensed.

It is a further purpose of this invention to provide a technique for dispensing the remaining propellant in a fashion that permits use of the propellant in selected situations.

It is also a further purpose of this invention to achieve the above purposes in a fashion that is safe and that provides a can for disposal which is safer than the can with the pressurized propellant.

BRIEF DESCRIPTION

There are two types of structural techniques that can provide the stop which permits propellant by-pass. Both provide a gap between piston and cap to avoid the sealing line or zone that occurs when the piston tops out on the cap of the can. They are:

1. The use of bumps to form a stop between piston and cap and thus provide the desired gap. This will normally not tilt the piston. Alternatively, an extension on the valve can provide a stop that holds the piston from topping out.

2. The use of a bump or marble in the well of the piston such that engagement with the tilt valve causes the, piston to skew. This provides for a more rapid discharge than when the piston remains orthogonal.

When the piston is caused to skew or tilt, the remaining propellant is discharged in a second or two. When the piston is not skewed but is simply prevented from topping out, the discharge is likely to take five or six seconds. The latter is advantageous when, for example, discharging the remaining propellant in a shaving cream can.

All embodiments of this invention involve a stop that keeps the piston from topping out against the cap. When the piston is stopped and thus not moving, propellant will force its way out around the sidewall of the piston, through the gap formed between piston and cap and out the open valve.

All embodiments release the propellant until the pressure on both sides of the piston is substantially equalized and renders the can safer for disposal.

An embodiment that also skews the piston provides a more rapid discharge of propellant which can be used to clean surfaces to which the product has been applied. Where a tire sealant product has been applied to a tire valve, this permits cleaning the tire valve seat through which the sealant has been inserted so that the tire valve core can be more readily reassembled.

Where the piston is skewed, this invention can be used to provide a gaseous inflation after the dispensing of product. To do such, calls for the inclusion of more of the liquid propellant than would normally be required.

DESCRIPTION OF THE PREFERRED EMBODIMENTS

Figure 1:
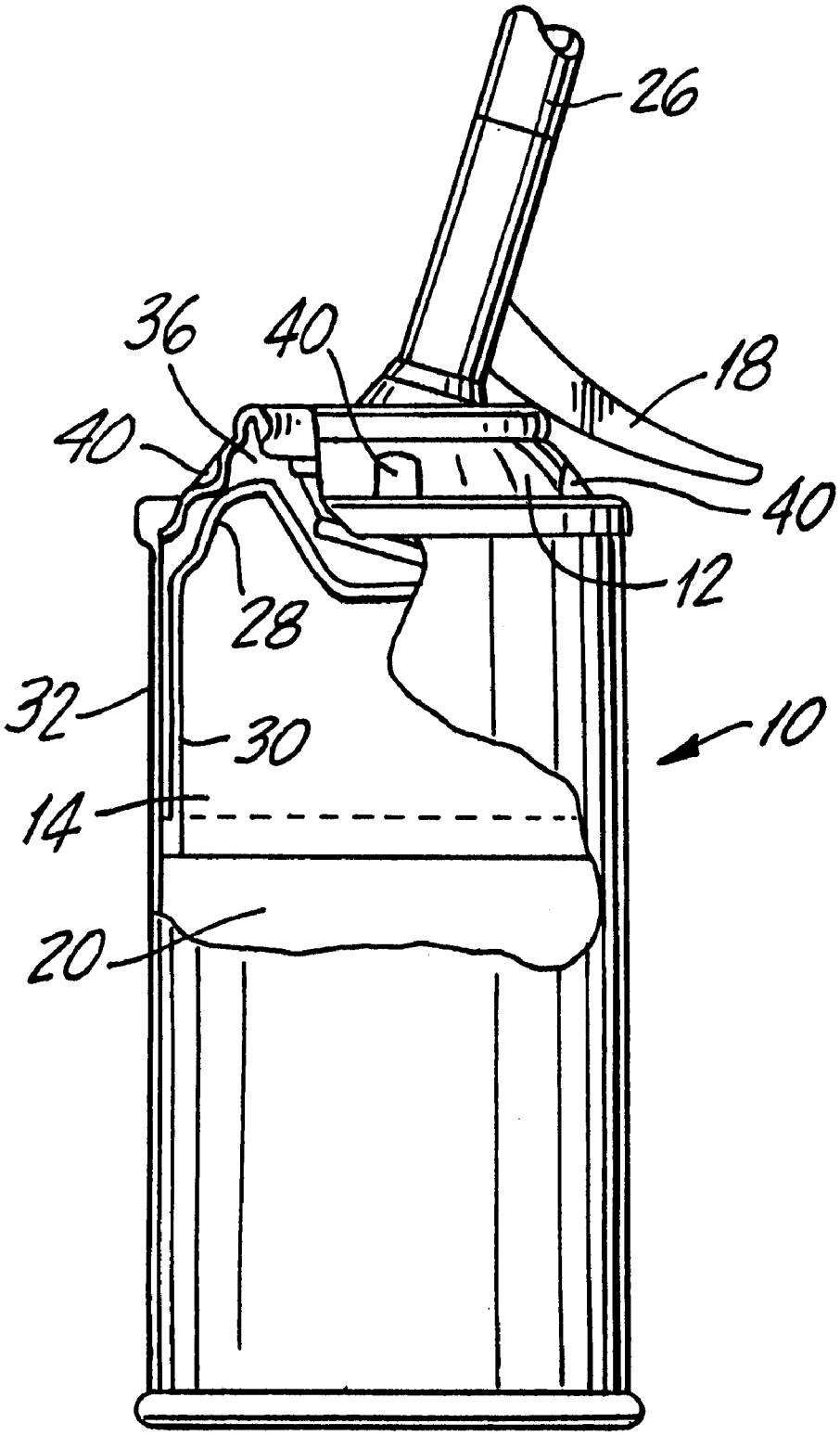
FIG. 1 is a longitudinal sectional view of a first embodiment of this invention in which bumps on the upper surface of the piston provide a stop that creates a gap between piston and container cap.

With reference to FIG. 1, a pressurized container 10 has a cap 12 and contains a piston 14 and a valve 16. In normal operation, the valve 16 is tilted by hand pressure on the handle 18. Under those conditions, pressure developed by propellant in the zone 20 below the piston 14 forces the material to be dispensed that is in the zone above the piston to exit through the valve openings 24 and thus out of the valve 16 and any associated nozzle 26 which has been added to the valve 24.

In most pressurized containers 10, in order to get the maximum amount of material dispensed, the piston 14 travels upward until the top surface 28 of the piston engages the inner wall of the cap 12. In order to provide a configuration that dispenses almost all of the material in the container 10 when the piston tops out, a sealing zone is created between piston 14 and cap 12. As a consequence, there is substantial propellant remaining in the zone 20 below the piston 14.

In known designs, the material to be dispensed is forced into the small space between the sidewall 30 of the piston 14 and the inner surface of the container sidewall 32. This provides a seal that prevents propellant from getting into the material to be dispensed when the valve is open and as long as the piston is moving up and dispensing product.

In accordance with the FIG. 1 first embodiment of this invention, four equally circumferentially spaced protuberances or stops 34 on the piston abut against the inner surface of the cap 12 when most of the product is dispensed. This creates a small gap 36 of twenty (20) to thirty (30) mils (0.020 to 0.030 inches). As a consequence, with the piston no longer able to move, when the valve 16 is in its open state, the propellant under pressure forces product that is between the sidewalls 30 and 32 up into the gap 36 between piston 14 and cap 12 and out of the valve. This gap 36 then provides a path for propellant to exit around the sidewall 30, through the gap 36 and out of the valve 16.

In a typical dispensing container, the clearance between piston and sidewall is normally three (3) to five (5) mills. In the FIG. 1 embodiment, the four stops 34 provide a gap 36 that is substantially greater than the sidewall clearance.

Figure 1A:
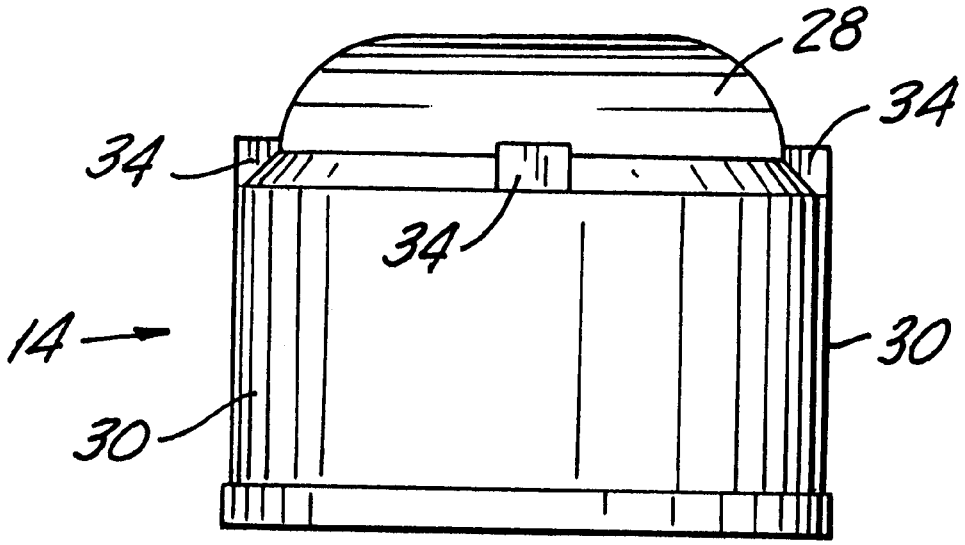
FIG. 1A is an elevation view of the piston in the FIG. 1 embodiment and FIG. 1B is an elevation view of a variant on the piston, which variant can be substituted for the FIG. 1A piston.
Figure 1B:
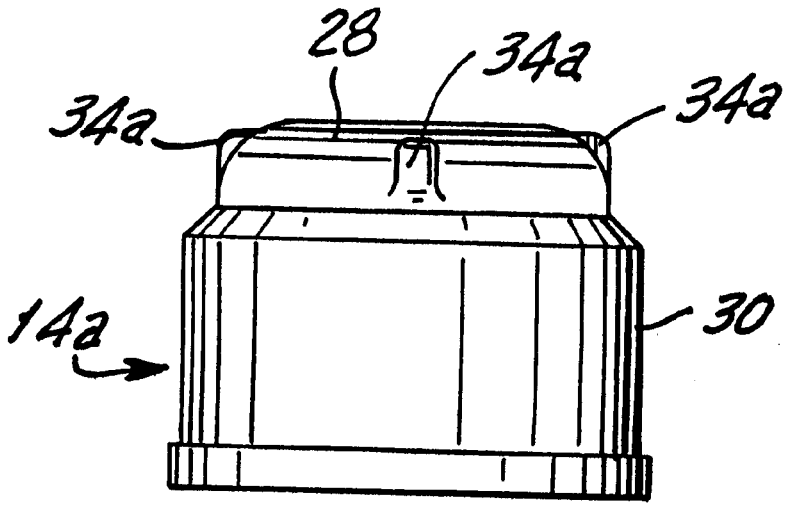

FIG. 1A shows the piston 14 of FIG. 1 in elevation view to better illustrate the stops 34 which extend up from the sidewall 30. FIG. 1B shows a variant on the FIG. 1A piston. The FIG. 1B piston 14*a* has four stops 34*a* which are equally circumferentially spaced on the surface of the piston dome 28.

Figure 2:
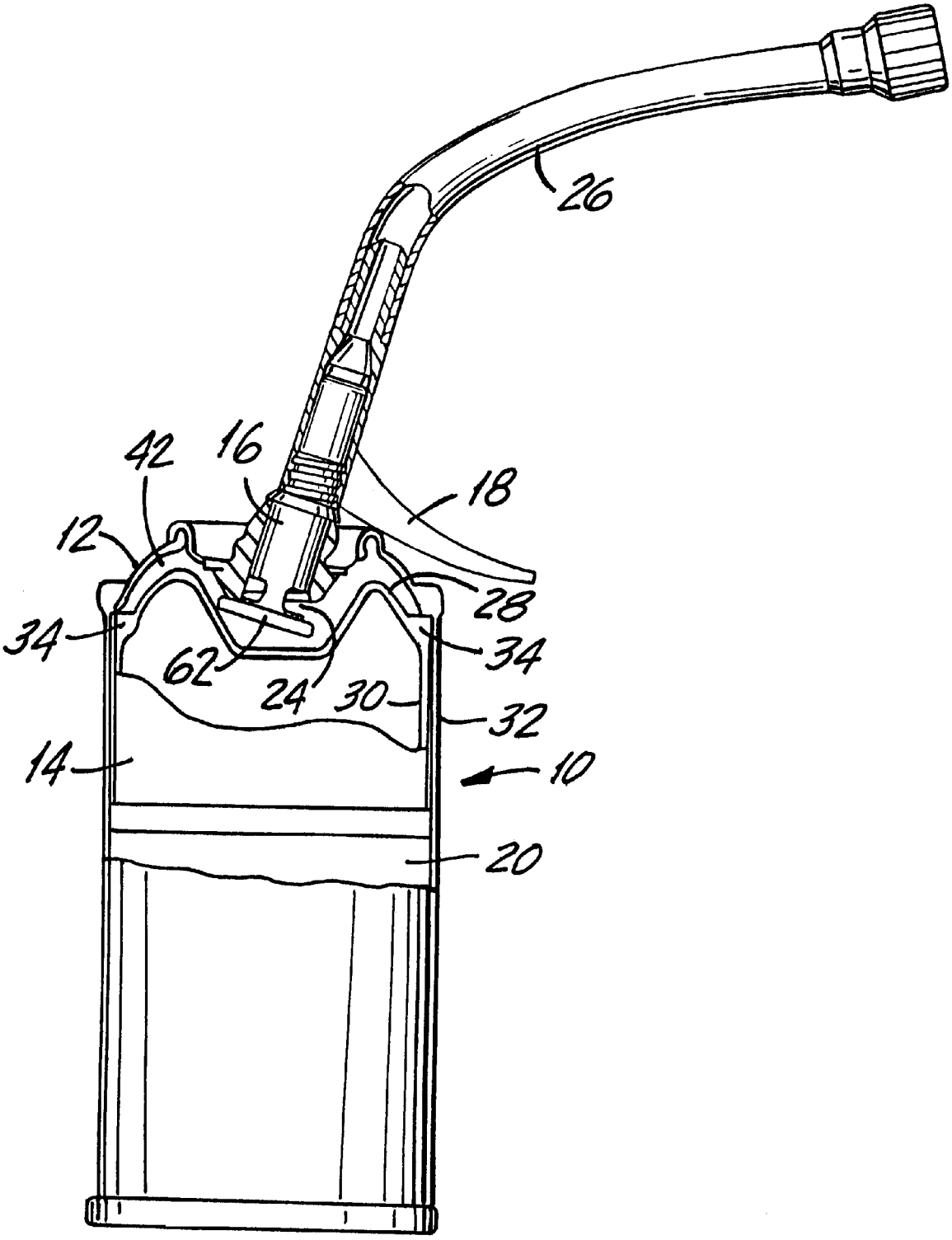
FIG. 2 is a longitudinal sectional view of a second embodiment of this invention in which bumps on the inner surface of the cap of the piston provide the stop that creates the desired gap between piston and cap.

FIG. 2 is an embodiment quite similar to that of FIG. 1 except that the stops or protuberances 40 are on the inner surface of the cap 12. These stops 40 provide the gap 42 that corresponds to the gap 36 in FIG. 1. The result provides the same exhaustion of propellant as in the FIG. 1 embodiment. Accordingly, in FIG. 2, as in the rest of FIGS. herein, the same reference numerals are used to refer to the corresponding components.

Figure 3:
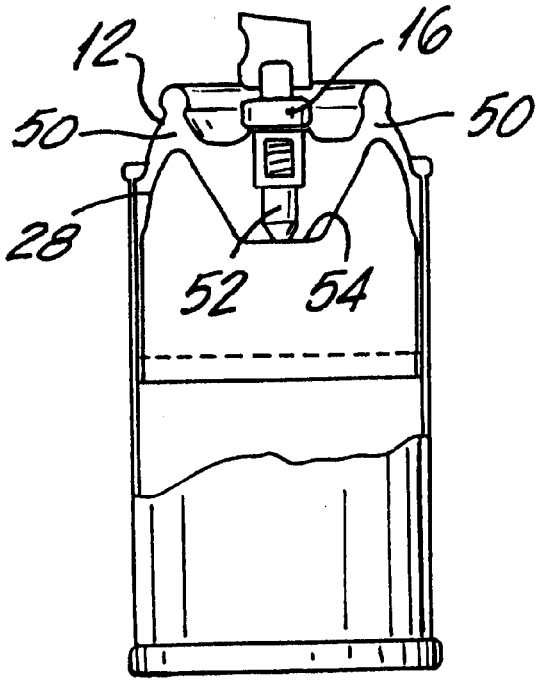
FIG. 3 is a longitudinal sectional view of a third embodiment of this invention in which an extension on the bottom of the valve provides a stop which creates the desired gap between piston and container cap.
Figure 3A:
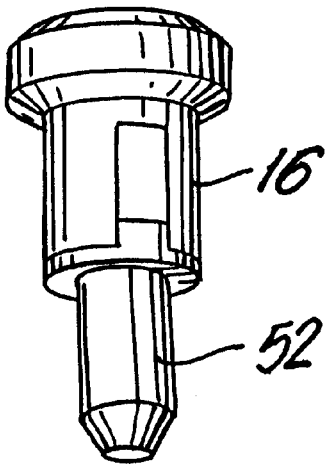
FIG. 3A is a perspective view of the valve 16 of FIG. 3.

The FIG. 3 embodiment provides the same results as the FIGS. 1 and 2 embodiments in creating a gap 50 between piston 14 and cap 12. But the gap 50 in the FIG. 3 embodiment is created by an extension 52 on the valve 16. This extension 52 is the stop which contacts the well 54 of the piston 14 before the piston 14 tops out on the cap 12 and thereby provides the desired gap 50. Once the stop 52 has engaged the well 54, and the gap 50 is created, the operation by which the propellant exits around the side of the piston 14 and through the gap 50 and out the valve 16 is substantially the same as in the embodiments described above.

Figure 4:
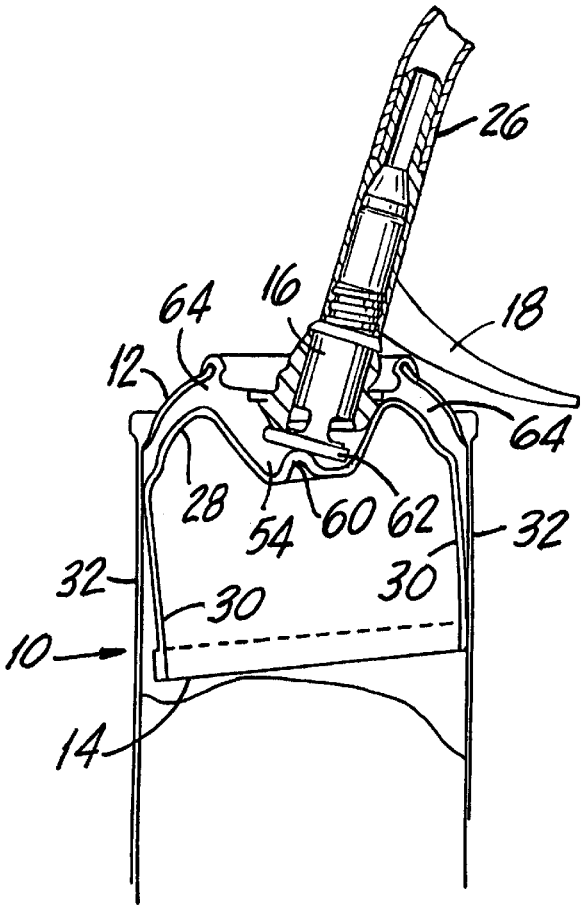
FIG. 4 is a longitudinal sectional view showing how an appropriate bump in the well of the piston provides a stop that engages the base of a tilt dispensing valve so that when the dispensing valve is tilted, the piston is tilted askew. The stop also assures the desired gap between piston and cap.

In the FIG. 4 embodiment, piston 14 is similar to the piston shown in the other embodiments except that the piston has a bump or stop 60 in the well 54 of the piston. This stop 60 engages the seat 62 of the valve 16 thereby creating the desired gap 64 between piston 14 and cap 12. As in all embodiments, propellant cannot be dispensed as long as the valve is closed because the material that fills the gap 64 prevents any passage of propellant. As shown in FIG. 4, when the valve 16 is tilted and placed in its dispensing state, a path is created through the gap 64 for dispensing propellant. In addition, the engagement between stop 60 and seat 12 causes the piston 14 to tilt askew to provide, along one portion of the piston sidewall 30, an enhanced path by which propellant can be dispensed. The plastic sidewall 30 is flexible enough to permit such skewing. Experience shows that this tilted piston arrangement causes the remaining propellant to be dispensed within a couple of seconds. By contrast in the embodiments of FIGS. 1 through 3 where the piston stays orthogonal, the propellant is dispensed more slowly and may take five or six seconds, depending on propellant pressure and the nature of the remaining material.

This tilt valve arrangement of FIG. 4 would be useful in connection with a tire sealant product where it might be desirable to have a quick blast of propellant to clean off the seat of the tire valve to permit ready reengagement of the tire valve with its seat.

Alternatively, an excess of propellant could be included in the tire sealant product. After the sealant has been dispensed and the engagement shown in FIG. 4 obtained, a substantial amount of propellant could be used to further inflate or partially inflate the tire involved.

Figure 5:
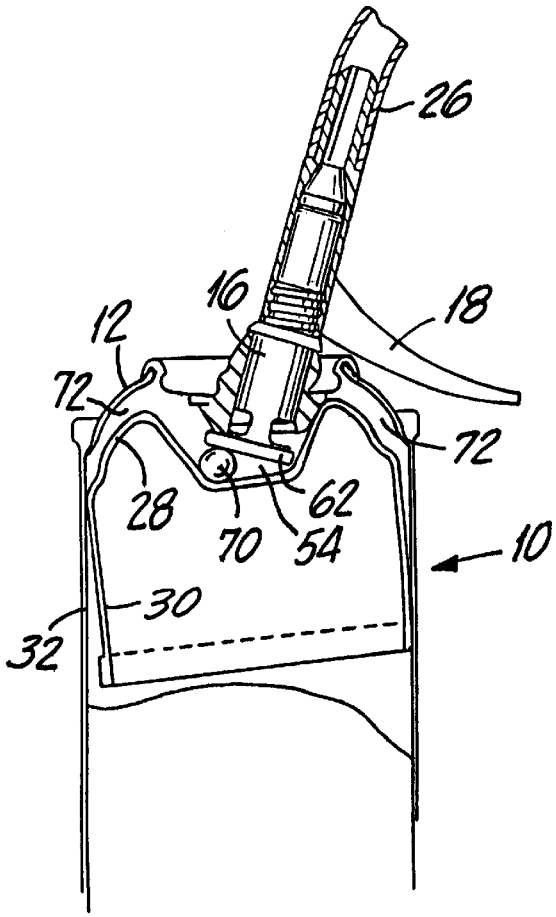
FIG. 5 is a longitudinal sectional view showing how a small ball or marble in the well of the piston provides a stop that engages the base of a tilt valve. When the valve is tilted, the piston will tilt askew in addition to being held back from a sealing engagement with the cap of the container.

The FIG. 5 embodiment operates in a fashion similar to the FIG. 4 embodiment except that instead of the FIG. 5 stop 60 in the well 54 of the piston 14, there is a small ball or marble 70 which operates to provide the stop that creates the desired gap 72. When the valve 16 is tilted into its dispensing state, the marble 70 engages the seat 62 of the valve causing the tilting or skewing of the piston 14. This provides the same result as described in connection with the FIG. 5 embodiment.

Although various embodiments of this invention have been described, other embodiments can be created and it should be understood that the claims cover all such non-disclosed embodiments.

For example, if only one or two adjacent stops 34 were used in the FIG. 1 embodiment, the piston 14 would skew. As another example, the tilt valve 16 could be a valve that moves axially between closed and dispensing states.

What is claimed is:

1. In a pressurized dispensing container having a valve and a piston within the container, the container having a cap and the piston having an upper surface which contacts the cap when the piston has topped out, the improvement comprising:

a stop between piston and cap, said stop creating a gap between piston and cap when the piston has topped out and the material in the container is substantially dispensed, said gap providing a passageway for propellant to exit from below the piston, around the wall of the piston, and through the valve of the dispensing container.

2. The improvement of claim 1 wherein said stop is on at least one of (a) the outer surface of the piston, (b) the inner surface of the container cap, (c) the well of the piston, and (d) the inner end of the valve.

3. The improvement of claim 1 wherein said stop holds said piston in an orthogonal position spaced from the cap.

4. The improvement of claim 1 wherein said stop causes the piston to skew to provide an enhanced passageway for the propellant around the wall of the piston.

5. The improvement of claim 1 wherein said stop is provided on the outer surface of the piston and engages the inner surface of the container cap to create said gap.

6. The improvement of claim 1 wherein said stop is on the inner surface of the container cap and engages the outer surface of the piston to create said gap.

7. The improvement of claim 1 wherein said stop is contained in the well of the piston and engages the valve to create said gap.

8. The improvement of claim 6 wherein said stop is a marble in the well of the piston.

9. The improvement of claim 1 wherein said stop is on the lower end of the valve and engages the well of the piston to create said gap.

10. The improvement of claim 4 wherein said stop engages the valve when the valve is tilted to cause the piston to skew.

11. In a pressurized dispensing container having a tilt valve and a piston within the container, the piston having an upper surface with a central well, the improvement comprising:

a stop in the well of the piston, said piston well stop engaging the lower end of the valve when the material in the container is nearly dispensed, tilting of the valve when said stop has engaged the valve causing the piston to skew and provide an enhanced passageway for propellant to exit around the wall of the piston and through the valve of the dispensing container.

12. The method of releasing propellant after product has been substantially dispensed from a pressurized dispensing container having a valve and piston comprising the steps of:

providing a stop to prevent the piston from topping out against the inner surface of the cap of the dispensing container to maintain a gap between the piston and the cap of the container, and dispensing the remaining propellant around the piston sidewall, through the gap and out of the valve.

13. The method of claim 12 further comprising the step of:

engaging the valves with said stop in a fashion that causes the piston to skew.

14. The method of providing by-pass for the propellant in a pressurized dispensing container having a valve and a floating piston within the container comprising the steps of:

providing a gap between the piston and the cap of the container when the material in the container has been substantially dispensed, and dispensing propellant from beneath the piston around the wall of the piston and through the valve of the dispensing container.

15. The method of claim 14 further comprising the step of:

skewing the piston while providing said gap to provide an enhanced passageway for the propellant around the piston.

* * * * *